US007614697B1

(12) United States Patent
Lai

(10) Patent No.: US 7,614,697 B1
(45) Date of Patent: Nov. 10, 2009

(54) COUPLING MECHANISM INTERPOSED BETWEEN A SEAT AND A BACK OF A CHAIR TO PREVENT A RECLINING MOTION OF THE BACK FROM TILTING THE SEAT

(75) Inventor: Chih-Yu Lai, Taibao (TW)

(73) Assignee: Fon Chin Industrial Co., Ltd., Chiayi County (TW)

( * ) Notice: Subject to any disclaimer, the term of this patent is extended or adjusted under 35 U.S.C. 154(b) by 0 days.

(21) Appl. No.: 12/213,219

(22) Filed: Jun. 17, 2008

(51) Int. Cl.
*A47C 3/026* (2006.01)
*A47C 1/024* (2006.01)
*A47C 1/032* (2006.01)
*A47C 1/038* (2006.01)

(52) U.S. Cl. ..... 297/301.4; 297/301.1; 297/301.5; 297/301.6; 297/301.7

(58) Field of Classification Search ..... 297/301.1, 297/301.4, 301.5, 301.6, 301.7
See application file for complete search history.

(56) References Cited

U.S. PATENT DOCUMENTS 3,601,444 A * 8/1971 Doerner ..... 297/301.3
4,198,094 A * 4/1980 Bjerknes et al. ..... 297/300.4
4,641,886 A * 2/1987 Dauphin ..... 297/300.3
4,709,962 A * 12/1987 Steinmann ..... 297/300.3
4,761,033 A * 8/1988 Lanuzzi et al. ..... 297/300.3
4,966,411 A * 10/1990 Katagiri et al. ..... 297/300.7
5,080,318 A * 1/1992 Takamatsu et al. .... 297/301.1 X
5,228,748 A * 7/1993 Neumuller ..... 297/300.1 X
5,286,088 A * 2/1994 Taylor et al. ..... 297/300.1 X
5,295,731 A * 3/1994 Dauphin ..... 297/300.1 X
5,333,368 A * 8/1994 Kriener et al. ..... 297/302.1
5,340,194 A * 8/1994 Neumuller ..... 297/301.3
5,356,200 A * 10/1994 Stumpf et al. ..... 297/301.1 X
5,397,165 A * 3/1995 Grin et al. ..... 297/300.5
5,423,594 A * 6/1995 Hancock et al. ..... 297/300.2
5,423,595 A * 6/1995 Hancock ..... 297/301.1 X
5,447,357 A * 9/1995 Dauphin ..... 297/301.4
5,573,303 A * 11/1996 Doerner ..... 297/300.5
5,660,439 A * 8/1997 Unwalla ..... 297/300.5 X
5,664,834 A * 9/1997 Hsu ..... 297/300.5 X
5,964,503 A * 10/1999 Inoue ..... 297/300.4
6,120,096 A * 9/2000 Miotto ..... 297/301.4
6,131,998 A * 10/2000 Su ..... 297/300.5 X (Continued)

FOREIGN PATENT DOCUMENTS

WO WO 8602536 A1 * 5/1986 ..... 297/301.1

*Primary Examiner*—Rodney B White
(74) *Attorney, Agent, or Firm*—Rosenberg, Klein & Lee

(57) ABSTRACT

A chair has a coupling mechanism between a seat and a back, which includes a joining member, and a coupling member; the seat has two opposite front and two opposite rear ears on a bottom; the joining member is secured on a supporting tube for the seat, and has two opposite sloping slots on each end, and intermediate adjustment slots; the connecting member has a front fixing hole, and a rear sloping slot; the joining member, the connecting member, and the seat are joined together with a first shaft passed through the front ears and the front sloping slots, with a second shaft passed through the rear ears and all of the rear sloping slots; a third shaft is passed through the adjustment slots and the fixing hole; the connecting member is further pivoted to the joining member at a middle portion; the back is joined to the connecting member.

2 Claims, 5 Drawing Sheets

U.S. PATENT DOCUMENTS

| | | | | |
|---|---|---|---|---|
| 6,419,320 | B1 * | 7/2002 | Wang | 297/300.8 X |
| 6,447,063 | B1 * | 9/2002 | Beggs | 297/300.5 |
| 6,572,191 | B2 * | 6/2003 | Wild | 297/301.4 |
| 6,588,843 | B1 * | 7/2003 | Ebenstein | 297/301.4 X |
| 6,659,554 | B2 * | 12/2003 | Su | 297/301.7 X |
| 6,705,677 | B2 * | 3/2004 | Oshima et al. | 297/300.2 |
| 6,874,853 | B2 * | 4/2005 | Wild | 297/301.4 X |
| 6,945,602 | B2 * | 9/2005 | Fookes et al. | 297/300.2 X |
| 7,147,285 | B2 * | 12/2006 | Lin | 297/301.1 |
| 2005/0104429 | A1 * | 5/2005 | Dobkin et al. | 297/301.4 |
| 2008/0174161 | A1 * | 7/2008 | Maier et al. | 297/301.4 |

* cited by examiner

COUPLING MECHANISM INTERPOSED BETWEEN A SEAT AND A BACK OF A CHAIR TO PREVENT A RECLINING MOTION OF THE BACK FROM TILTING THE SEAT

BACKGROUND OF THE INVENTION

1. Field of the Invention

The present invention relates to a coupling mechanism interposed between a seat and a back of a chair, more particularly one, which can prevent a reclining motion of the back from causing the seat to tilt, thus allowing the chair to remain steady.

2. Brief Description of the Prior Art

Chair backs come in a wide variety of designs, yet they can be into two major types, fixed backs and reclineable ones. Reclineable chair backs allow the sitters to recline in a relaxed way. However, most currently existing reclineable chair backs will cause the seats to tilt when they move to the reclining position. Consequently, the sitter would feel insecure, and the chair will become unsteady, and can fall over to cause danger.

Therefore, it is a main object of the present invention to provide an improvement on a coupling mechanism between a seat and a back of a chair, which can prevent a reclining motion of the back from causing the seat to tilt, thus overcoming the above problems.

SUMMARY OF THE INVENTION

A coupling mechanism for a seat and a back of a chair in accordance with an embodiment of the present invention includes a joining member, and a coupling member. The seat has two opposite front and two opposite rear pivotal ears on a bottom. The joining member is securely joined on a supporting tube for the seat, and has two opposite sloping slots on each of front and rear portions thereof, and adjustment slots between the front and the rear portions. The connecting member has a front fixing hole, and a rear sloping slot. The joining member, the connecting member, and the seat are joined together with a first shaft passed through the front ears and the front sloping slots, with a second shaft passed through the rear ears and all the rear sloping slots. And, a third shaft is passed through the adjustment slots of the joining member and the fixing hole of the connecting member. The connecting member is further pivoted to the joining member at a middle portion, and the back is securely joined to the connecting member.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
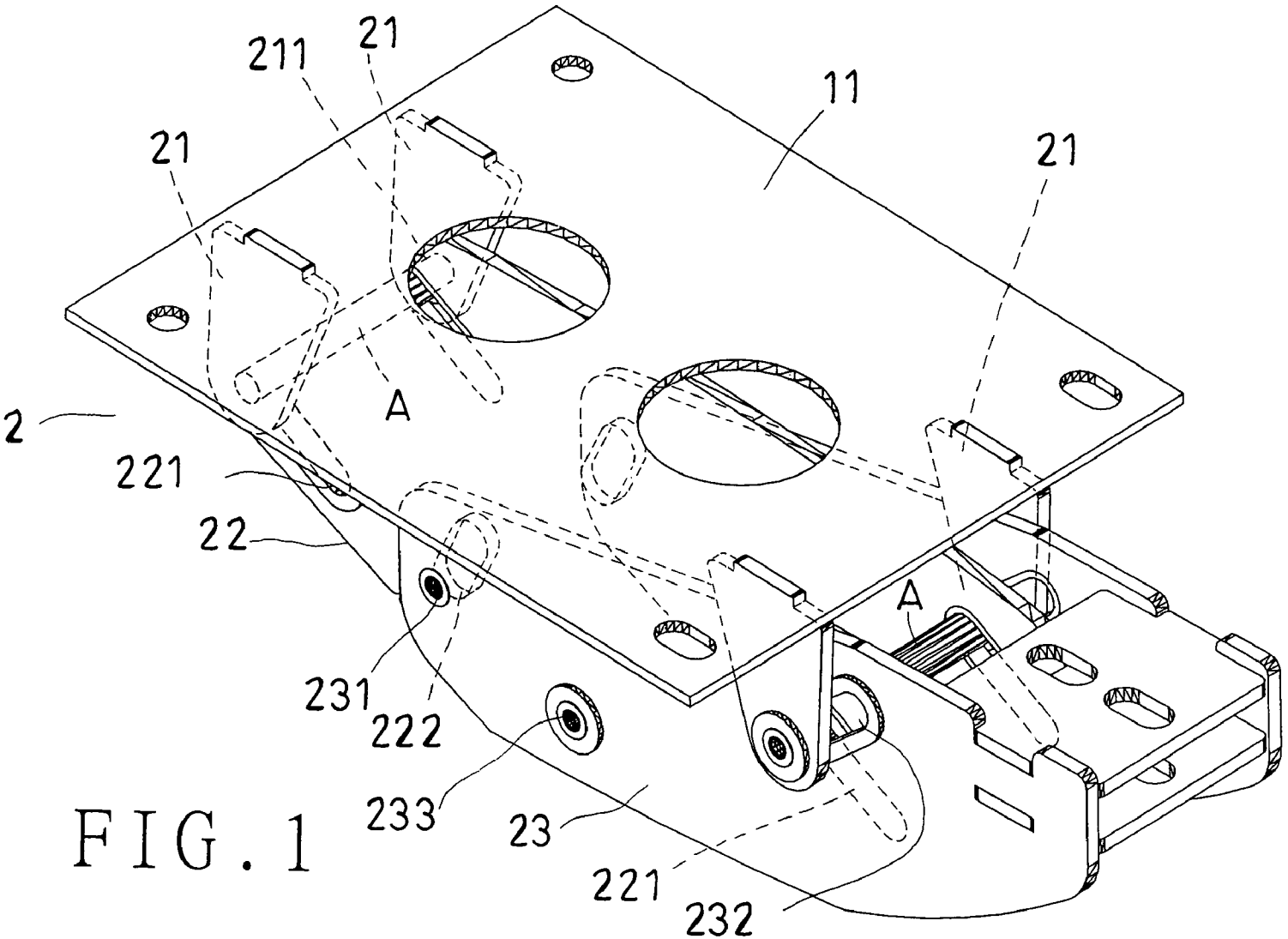
FIG. 1 is a perspective view of the present invention.
Figure 2:
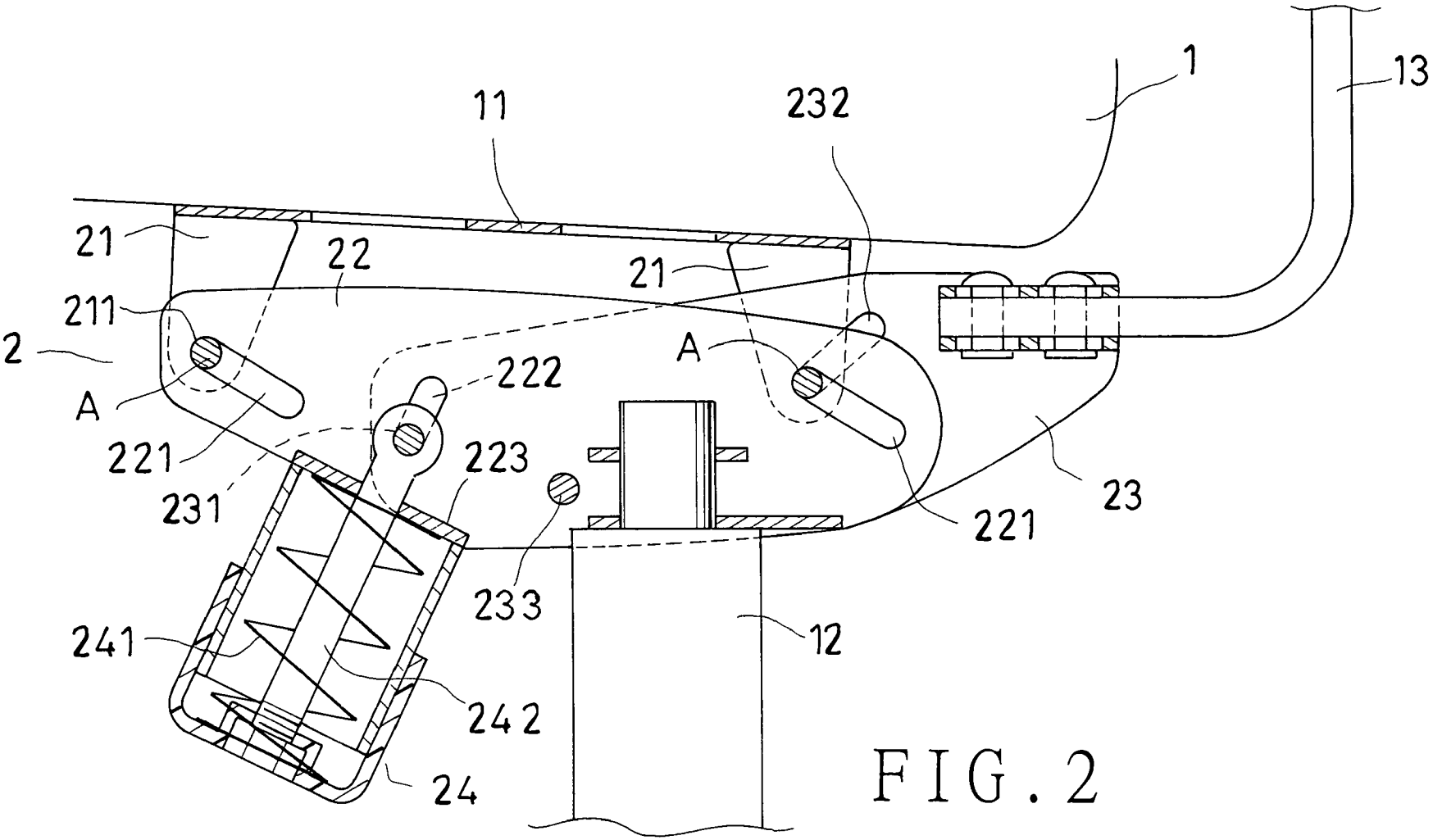
FIG. 2 is a sectional view of the present invention, taken when the chair back is in a substantially upright position.
Figure 3:
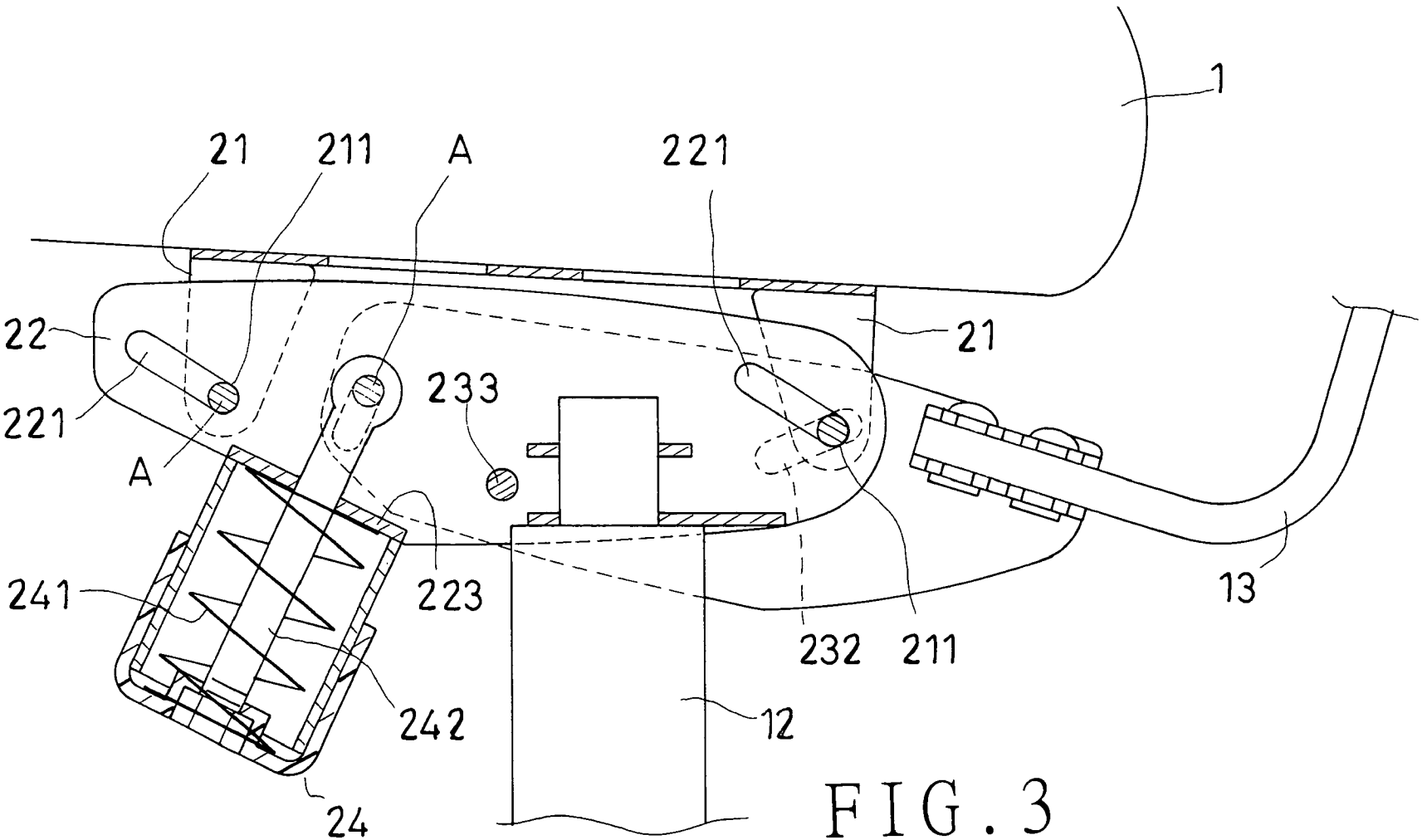
FIG. 3 is a sectional view of the present invention, taken when the chair back is in a reclined position.

Referring to FIG. 1 to FIG. 3, a preferred embodiment 2 of a coupling mechanism between a back and a seat of a chair in the present invention includes a pair of opposite front pivotal ear parts 22 and a pair of opposite rear pivotal ear parts 22 secured on a joining base member 11 on a bottom of a seat 1 of a chair, a joining member 22, and a connecting member 23.

Each of the front and the rear pivotal ear parts 21 has a through hole 211 thereon. The joining member 22 is securely joined on a supporting tube 12 for the seat 1. The joining member 22 has two opposite lateral wall portions. Each of the lateral wall portions of the joining member 22 has a sloping slot 221 on each of front and rear portions thereof; the sloping slots 221 slope downwards towards rear ends thereof. Each of the lateral wall portions of the joining member 22 has an adjustment slot 222 between the front and the rear sloping slots 221 thereof.

The connecting member 23 is securely joined to a back 13 of the chair. The connecting member 23 has a fixing hole 231 on a front portion thereof, and a sloping slot 232 on a rear portion thereof, which slopes upwards towards a rear end thereof. Furthermore, the connecting member 23 a pivotal portion 233 between the fixing hole 231 and the sloping slot 232 thereof.

Figure 4:
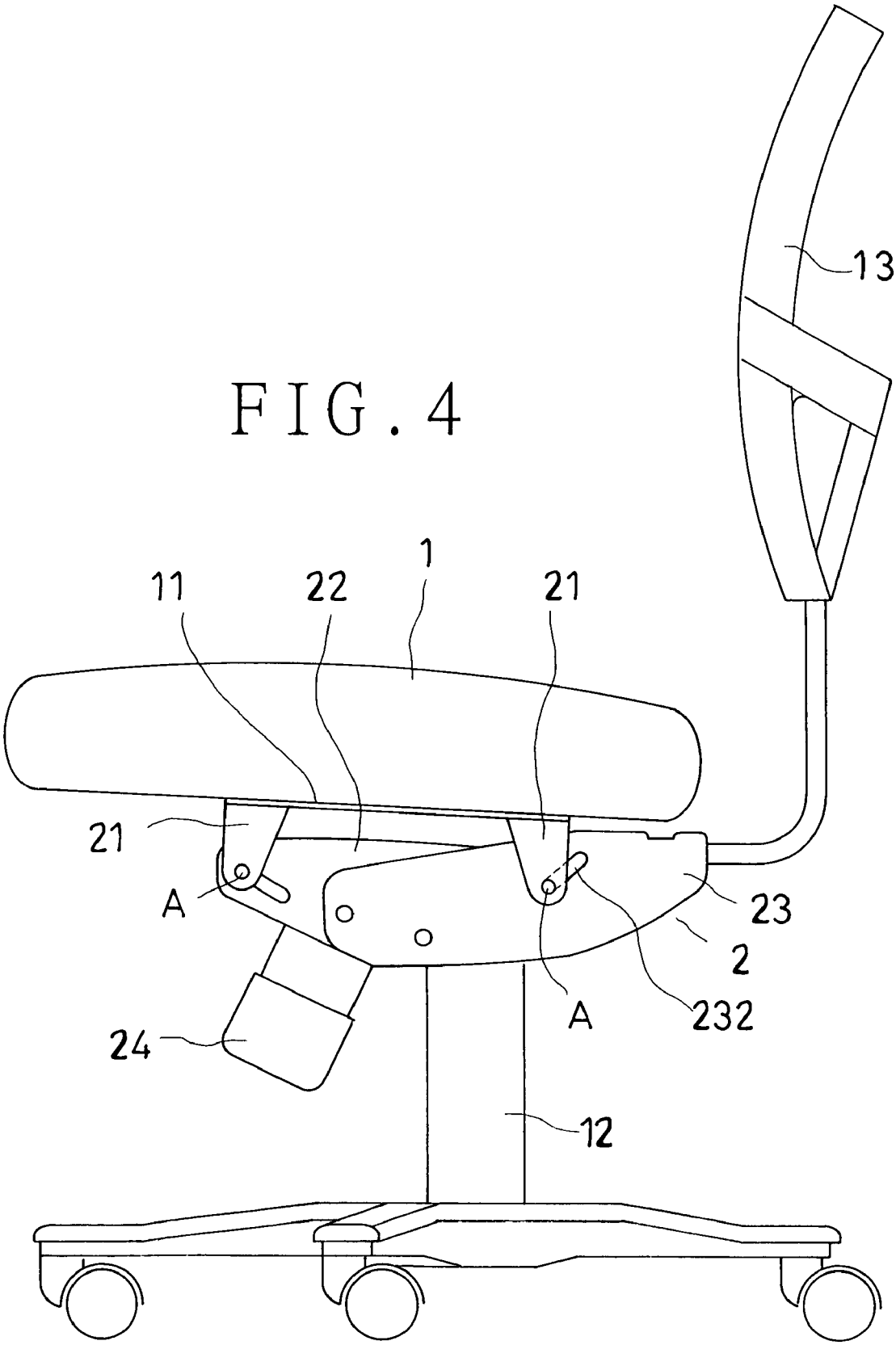
FIG. 4 is a side view of a chair with the coupling mechanism of the invention, taken when the back is in a substantially upright position.

In assembly, referring to FIGS. 1, 2 and 4, the joining member 22, the connecting member 23, and the seat 1 are joined together with a first pivotal shaft (A) being passed through the through holes 211 of the front pivotal ear parts 21 and the front sloping slots 221 of the joining member 22, and with a second pivotal shaft (A) being passed through the through holes 211 of the rear pivotal ear parts 21, the rear sloping slots 221 of the joining member 22, and the sloping slot 232 of the connecting member 23. And, a third pivotal shaft (A) is passed through the adjustment slots 222 of the joining member 22 and the fixing hole 231 of the connecting member 23. Furthermore, the connecting member 23 is pivoted to the joining member 22 at the pivotal portion 233 thereof. The back 13 is securely joined to the connecting member 23.

The coupling mechanism 2 of the present invention further includes a locating plate 223, and an elasticity adjustment device 24 installed on the locating plate 223; the locating plate 223 is positioned under the adjustment slots 222 of the joining member 22 as well as the connecting member 23. The elasticity adjustment device 24 includes a spindle 242, and an elastic element 241: the spindle 242 is securely joined to the third pivotal shaft (A) passed through the adjustment slots 222 of the joining member 22; the elastic element 241 is positioned around the spindle 242, and it will change in length when the elasticity adjustment device 24 is turned.

Figure 5:
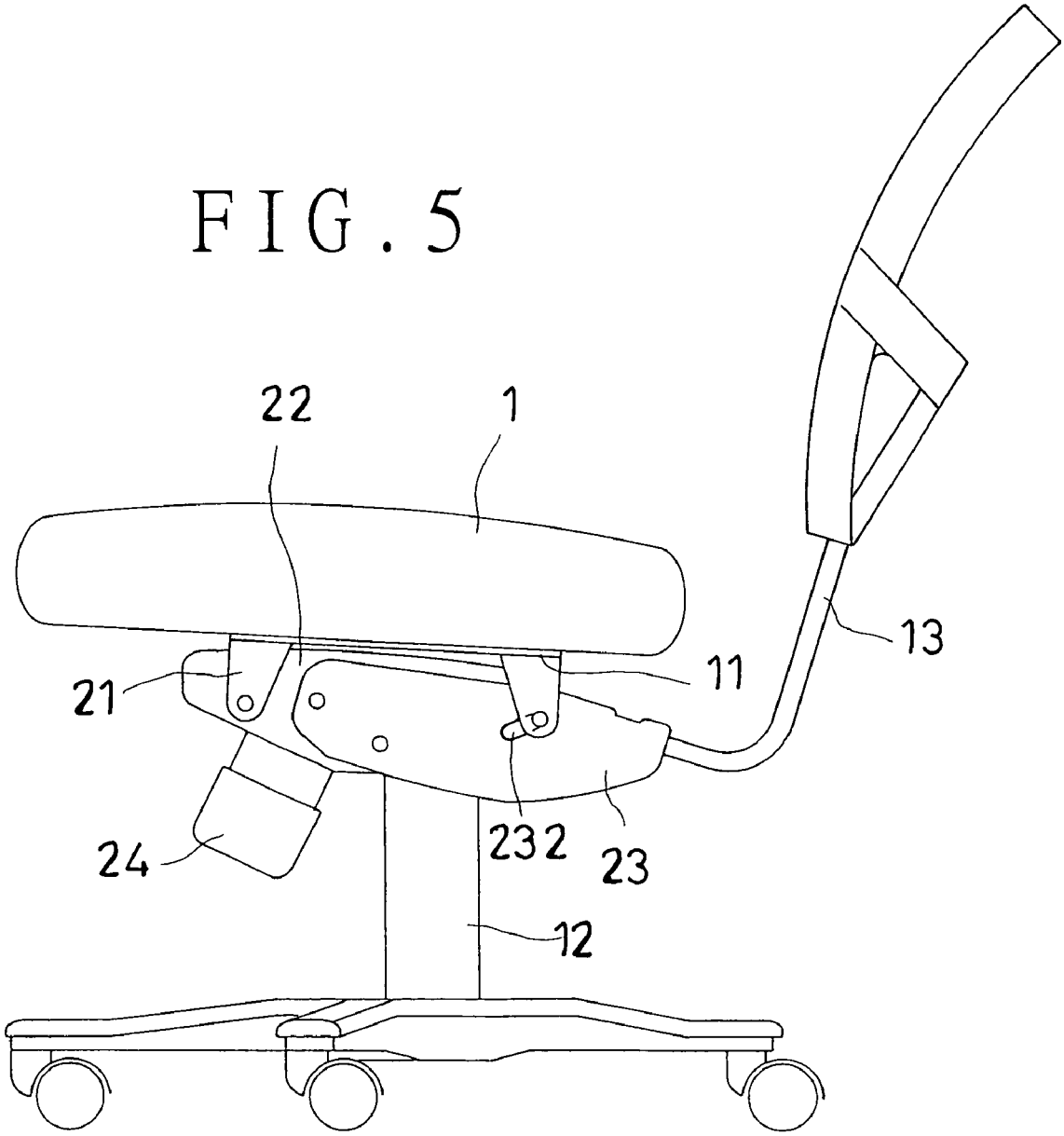
FIG. 5 is a side view of a chair with the coupling mechanism of the present invention, taken when the back is in a reclined position.

The back 13 of the chair is usually in a substantially upright position, as shown in FIGS. 2 and 4. Referring to FIGS. 3 and 5, when the sitter leans back to move the back 13 to a reclined position, the back 13 will cause the connecting member 23 to move such that the second pivotal shaft (A) will change position from a lower end of the sloping slot 232 of the connecting member 23 to an upper end of the sloping slot 232, and the third pivotal shaft (A) joined in the fixing hole 231 will move towards upper ends of the adjustment slots 222 of the joining member 22; thus, the joining member 22 is raised with the first pivotal shaft (A) being relocated from upper ends to lower ends of the front sloping slots 221 of the joining member 22, and with the second pivotal shaft (A) changing position from upper ends to lower ends of the rear sloping slots 221. Consequently, the seat 1 will remain stable in the horizontal position, without tilting owing to the reclining motion of the back 13.

From the above description, it can be seen that the coupling mechanism for a seat and a back of a chair in the present invention has the following advantages over the prior art:

1. The coupling mechanism of the present invention will prevent the seat from changing in position when the sitter leans back to recline the back. Therefore, the chair will remain steady, and the sitter will feel secure in a reclining position on the chair.

2. The coupling mechanism of the present invention will prevent the seat from tilting when the sitter leans back to recline the back. Therefore, the chair will remain steady without the risk of falling over to cause danger or moving in such a way as to frighten the sitter.

What is claimed is:

1. A coupling mechanism between a seat and a back of a chair to prevent the seat from tilting with reclining of the back, comprising a pair of opposite front pivotal ear parts and a pair of opposite rear pivotal ear parts secured on a joining base member on a bottom of a seat of a chair; each of the front and the rear pivotal ear parts having a through hole thereon;

a joining member securely joined on a supporting tube for the seat; the joining member having two opposite lateral wall portions; each of the lateral wall portions having a sloping slot on each of front and rear portions thereof; the sloping slots each sloping downwards towards a rear end thereof; the seat being joined on the joining member in a movable manner with a first pivotal shaft being passed through the through holes of the front pivotal ear parts and the front sloping slots of the joining member, and with a second pivotal shaft being passed through the through holes of the rear pivotal ear parts and the rear sloping slots of the joining member; each of the lateral wall portions of the joining member having an adjustment slot between the front and the rear sloping slots thereof;

a connecting member joined to the back; the connecting member having a fixing hole on a front portion thereof, and a sloping slot on a rear portion thereof; the sloping slot sloping upwards towards a rear end thereof; the connecting member and the joining member being joined together with a third pivotal shaft being passed through the adjustment slots of the joining member and the fixing hole of the connecting member, and with said second pivot shaft being passed through the sloping slot of the connecting member; the connecting member having a pivotal portion between the fixing hole and the sloping slot thereof; the connecting member being pivoted to the joining member at the pivotal portion thereof.

2. The coupling mechanism between a seat and a back of a chair to prevent the seat from tilting with reclining of the back as claimed in claim 1 further comprising a locating plate, and an elasticity adjustment device installed on the locating plate;

the locating plate being positioned under the adjustment slots of the joining member and the connecting member;

the elasticity adjustment device including:

a spindle securely joined to the third pivotal shaft passed through the adjustment slots of the joining member; and an elastic element positioned around the spindle; the elastic element adapted to change in length when the elasticity adjustment device is turned.

* * * * *